US011590372B2

(12) United States Patent
Turner

(10) Patent No.: US 11,590,372 B2
(45) Date of Patent: Feb. 28, 2023

(54) FIRE PROTECTION SYSTEM

(71) Applicant: Johnny Turner, Drummond, OK (US)

(72) Inventor: Johnny Turner, Drummond, OK (US)

( * ) Notice: Subject to any disclaimer, the term of this patent is extended or adjusted under 35 U.S.C. 154(b) by 76 days.

(21) Appl. No.: 17/358,390

(22) Filed: Jun. 25, 2021

(65) Prior Publication Data

US 2022/0314047 A1 Oct. 6, 2022

Related U.S. Application Data

(60) Provisional application No. 63/168,025, filed on Mar. 30, 2021.

(51) Int. Cl.
*A62C 3/02* (2006.01)
*A62C 35/02* (2006.01)

(52) U.S. Cl.
CPC ..... *A62C 3/0214* (2013.01); *A62C 3/0264* (2013.01); *A62C 35/023* (2013.01)

(58) Field of Classification Search
CPC ..... A62C 35/023; A62C 35/68; A62C 35/62; A62C 3/0214; A62C 3/0264; A62C 3/0292; A62C 5/02; A62C 5/022; A62C 31/12; B01F 23/291; B05B 15/74; Y10S 261/26
See application file for complete search history.

(56) References Cited

U.S. PATENT DOCUMENTS 2,953,160 A * 9/1960 Brazier ..... B01F 25/31243 137/895
8,109,341 B1 * 2/2012 Szocs ..... A62C 5/022 239/597
2020/0188714 A1 * 6/2020 Hofmann ..... G01F 5/00

* cited by examiner

*Primary Examiner* — Christopher R Dandridge
(74) *Attorney, Agent, or Firm* — Hall Estill Law Firm

(57) ABSTRACT

A fire protection system that includes a fluid supply and a fluid delivery apparatus. The fluid delivery apparatus receives fluid from the fluid supply and delivers a protectant solution to a building to prevent the building from catching fire. The fluid delivery apparatus includes an expansion chamber having an inlet for receiving fluid from the fluid supply, and an outlet where the protectant solution exits the expansion chamber. The fluid delivery apparatus also includes a resource line in fluid communication with the expansion chamber to provide a flame resistant substance to the expansion chamber from a reservoir. Further, the fluid delivery apparatus includes a vent line in fluid communication with the reservoir and the expansion chamber, a pressure difference between the vent line and the resource line causes the fluid in the vent line to push the flame resistant substance from the reservoir to the expansion chamber via the resource line. A method of installing the fire protection system on a building. The fluid delivery apparatus of the fire protection system can be provided to receive fluid from the fluid supply and positioned adjacent to desirous parts of the building to deliver a protectant solution from the fluid delivery apparatus to the building.

12 Claims, 5 Drawing Sheets

FIRE PROTECTION SYSTEM

CROSS-REFERENCE TO RELATED APPLICATIONS

The present application is a conversion of U.S. Provisional Application having U.S. Ser. No. 63/168,025, filed Mar. 30, 2021, which claims the benefit under 35 U.S.C. 119(e). The disclosure of which is hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The present disclosure relates to a fire protection system for preventing a building, any structure with a roof and walls standing more or less in one place, from catching on fire from a wildfire or a fire that is burning in an adjacent building.

2. Description of the Related Art

Typically, when a wildfire is burning in a given area, an evacuation order will be given. Similarly, when a building is on fire, an adjacent building to the building on fire will be evacuated in the event the adjacent building might catch fire. Oftentimes, in these situations the building being evacuated will catch fire and burn. Some buildings have fire suppression systems, but the fire suppression systems only operate once a building is on fire.

Accordingly, there is a need for a fire protection system that can be used on a building to prevent the building from ever catching on fire.

SUMMARY OF THE DISCLOSURE

The present disclosure is directed to a fire protection system. The fire protection system including a fluid supply and a fluid delivery apparatus. The fluid delivery apparatus receives fluid from the fluid supply and delivers a protectant solution to a building to prevent the building from catching fire. The fluid delivery apparatus includes an expansion chamber having an inlet for receiving fluid from the fluid supply, and an outlet where the protectant solution exits the expansion chamber. The fluid delivery apparatus also includes a resource line in fluid communication with the expansion chamber to provide a flame resistant substance to the expansion chamber from a reservoir. Further, the fluid delivery apparatus includes a vent line in fluid communication with the reservoir and the expansion chamber, a pressure difference between the vent line and the resource line causes the fluid in the vent line to push the flame resistant substance from the reservoir to the expansion chamber via the resource line.

The present disclosure is also directed to a method of installing the fire protection system on a building. The fluid delivery apparatus of the fire protection system can be provided to receive fluid from the fluid supply and positioned adjacent to desirous parts of the building to deliver a protectant solution from the fluid delivery apparatus to the building.

DETAILED DESCRIPTION OF THE DISCLOSURE

Figure 1A:
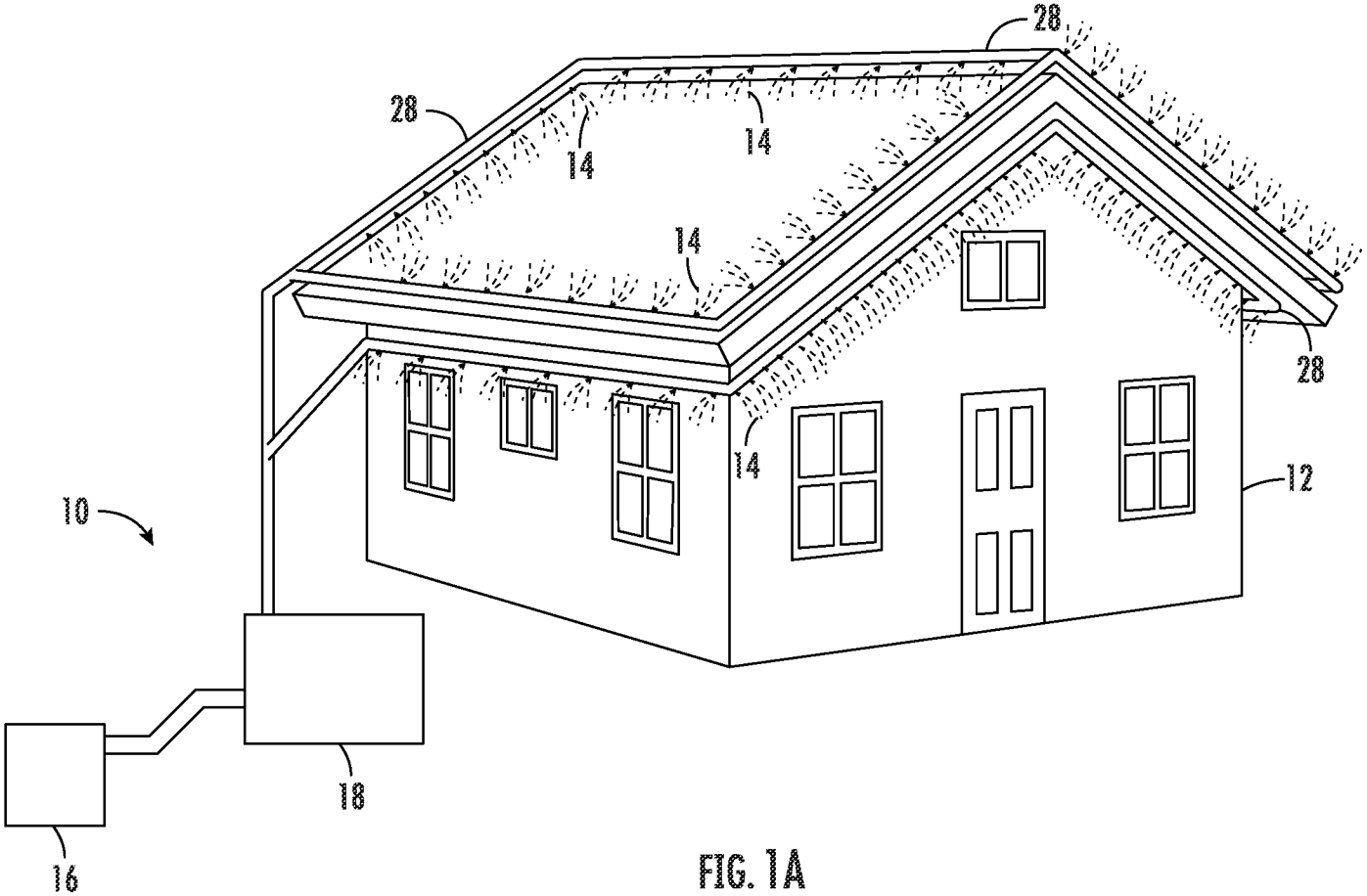
FIGS. 1A and 1B are perspective views of a fire protection system used in conjunction with a building constructed in accordance with the present disclosure.
Figure 1B:
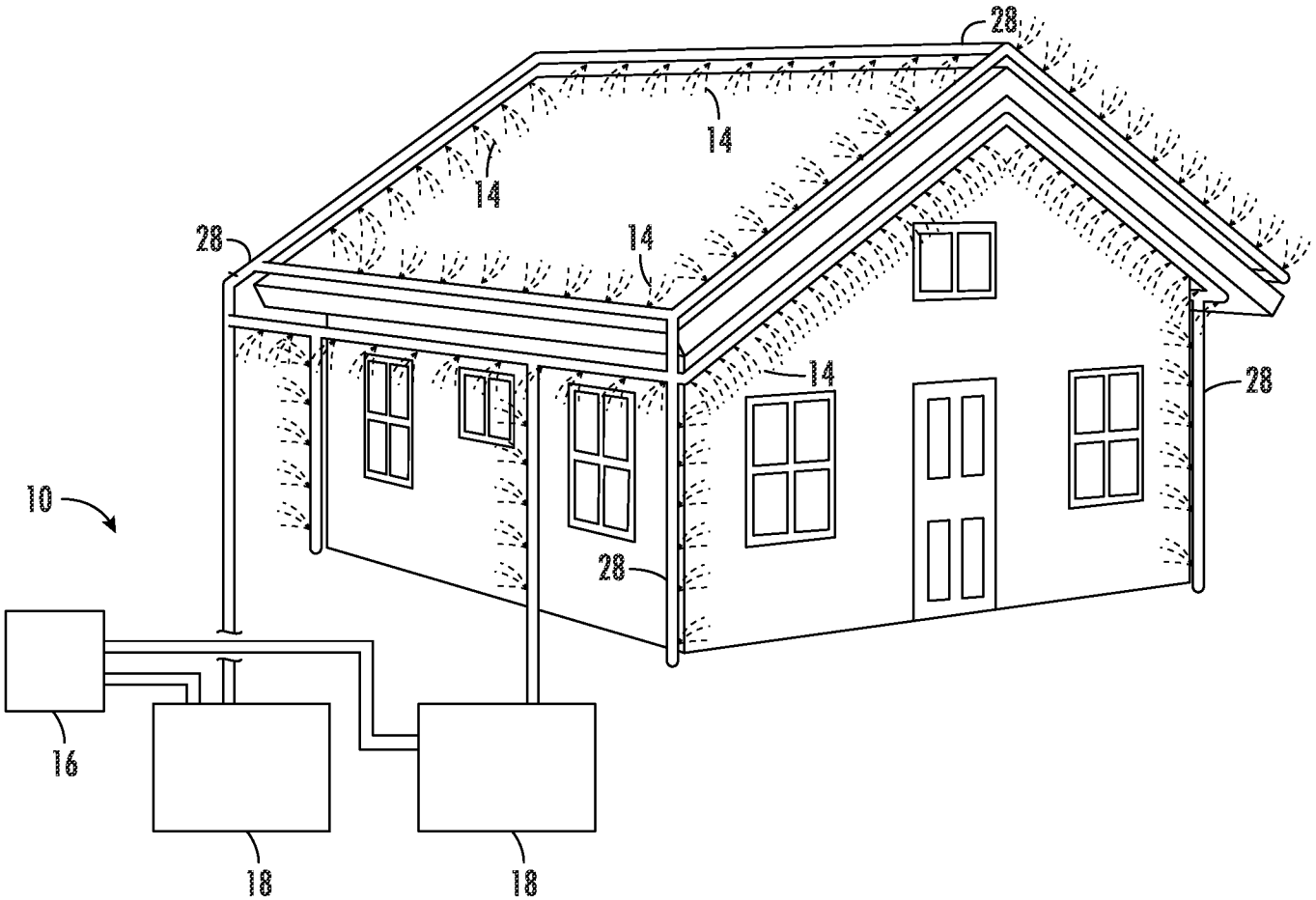
Figure 2:
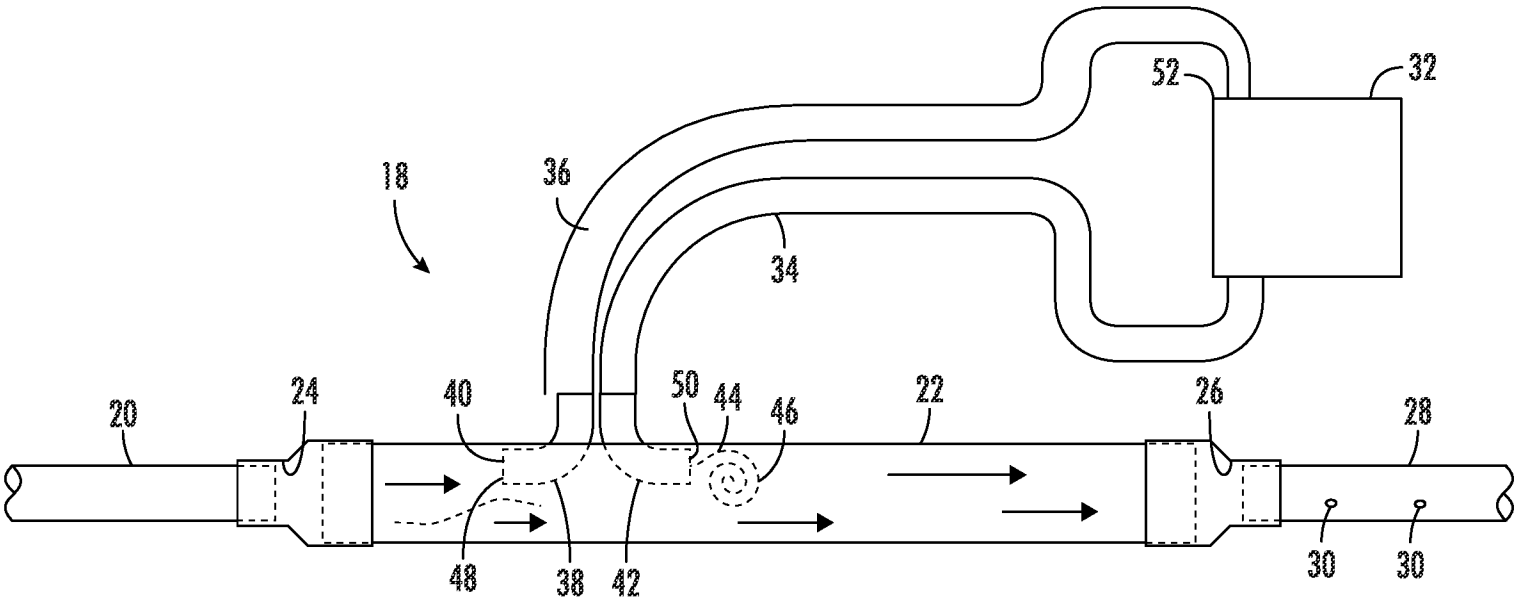
FIG. 2 is a side elevation view of the fire protection system constructed in accordance with the present disclosure.
Figure 3:
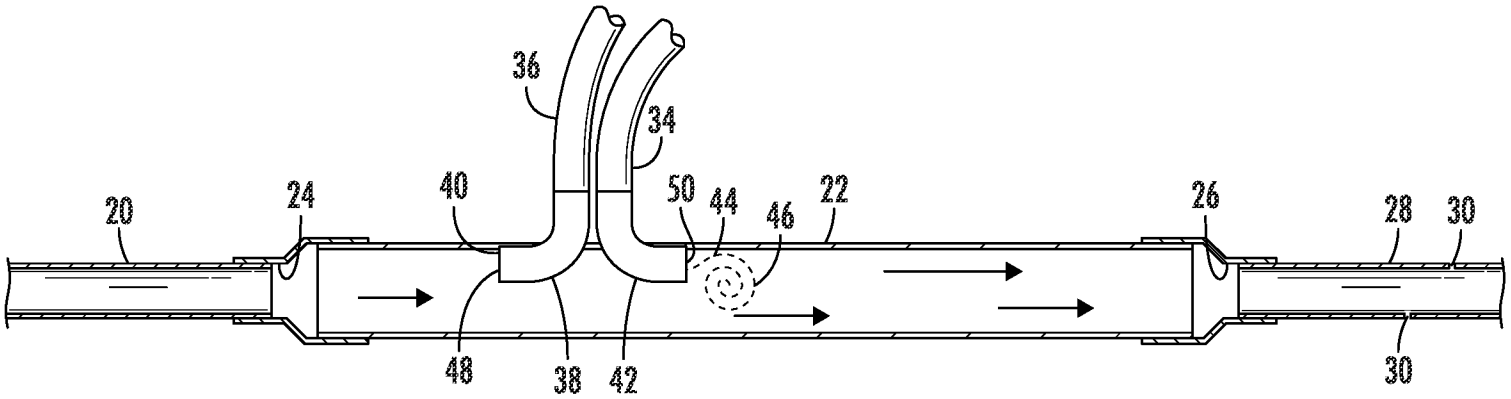
FIG. 3 is a cross-sectional view of the fire protection system constructed in accordance with the present disclosure.
Figure 4A:
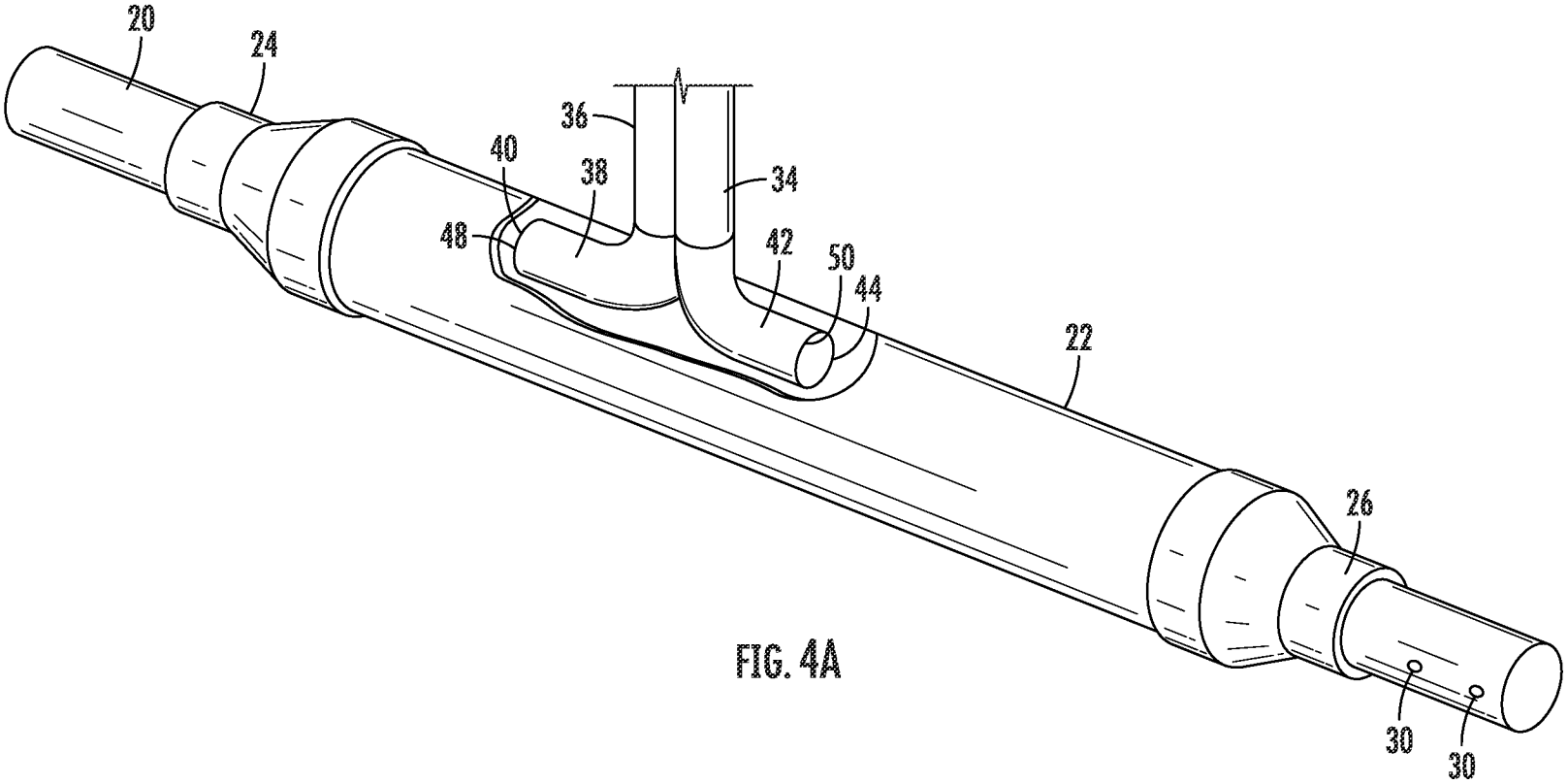
FIGS. 4A and 4B are perspective views of a portion of the fire protection system constructed in accordance with the present disclosure.
Figure 4B:
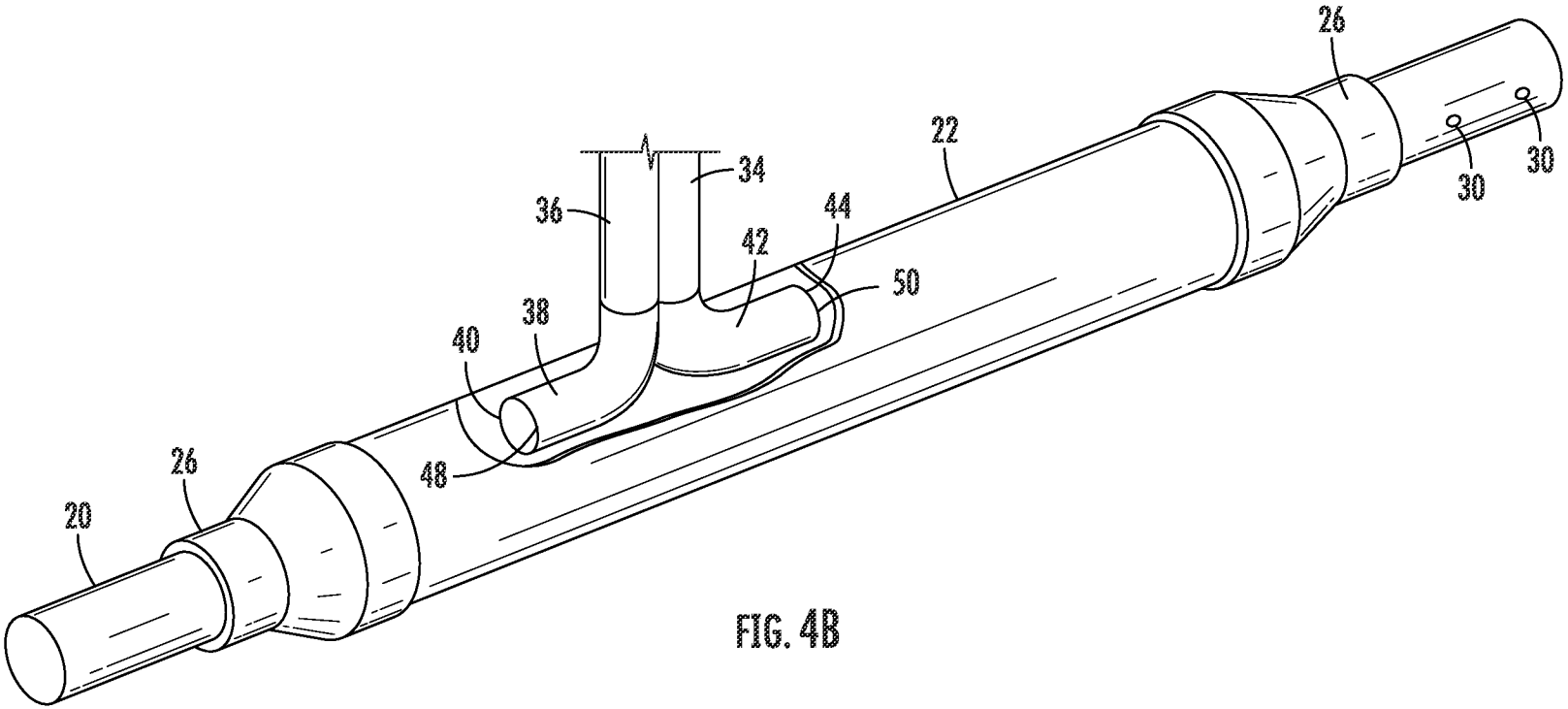

The present disclosure relates to a fire protection system 10 for use with a building 12 to disperse a protectant solution 14 on the building 12 when a wildfire is near, or when an adjacent building is on fire. Referring now to FIG. 1, shown therein is a building 12 with at least one fire protection system 10 used thereon. When a fire is near a building 12, the fire protection system 10 can be activated to spray the protectant solution 14 on the building 12 to prevent the building 12 from catching fire. Depending upon the size of the building 12, the building 12 being protected from fire can include multiple fire protection systems 10 disposed thereon.

The fire protection system 10 includes a fluid supply 16 to provide a desired fluid to a fluid delivery apparatus 18. The fluid supply 16 can be a well, water supplied to a building from a municipality, or some other water supply source. The pressure of the fluid from the fluid supply 16 can be relatively low. The fire protection system 10 can operate effectively at fluid pressures from about 20 psi and above. The fluid from the fluid supply 16 can be delivered to the fluid delivery apparatus 18 via a supply conduit 20.

The fluid delivery apparatus 18 includes an expansion chamber 22 where the fluid can be mixed with a flame resistant substance to create the protectant solution 14. The expansion chamber 22 has an inlet 24 for receiving the fluid from the fluid supply 16 via the supply conduit 20 and an outlet 26 for delivering the protectant solution 14 to a spray conduit 28. The expansion chamber 22 has a larger diameter than the diameter of the inlet 24 (and/or the diameter of the supply conduit 20) where the fluid from the fluid supply 16 enters the expansion chamber 22 and a larger diameter than the diameter of the outlet 26 (and/or the diameter of the spray conduit 28) where the protectant solution 14 exits the expansion chamber 22. In one embodiment, the diameter of the expansion chamber 22 is greater than the diameter of the inlet by 60% to 200%. In another embodiment, the diameter of the expansion chamber 22 is greater than the diameter of the inlet by 60% to 100%. In yet another embodiment, the diameter of the expansion chamber 22 is greater than the diameter of the inlet by 100% to 150%. In a further embodiment, the diameter of the expansion chamber 22 is greater than the diameter of the inlet by 150% to 200%. In an exemplary embodiment, if the diameter of the inlet is 0.75 inches, the diameter of the expansion chamber could be about 1.2 inches to about 2.25 inches.

The spray conduit 28 can have notches or openings 30 disposed therein to permit the protectant solution 14 to be distributed to desired areas on the outside of the building 12 to prevent the building 12 from catching fire. Nozzles can be disposed in the spray conduit 28 to provide a specific velocity and dispersion pattern of the protectant solution 14 delivered to the building 12. It should be understood and appreciated that the spray conduit 28 can be any length such that a desired area to be covered with the protectant solution 14 is accomplished. The spray conduit 28 can also include any number of notches, openings or nozzles disposed therein to adequately cover a desired area of the building 12.

The fire protection system 10 can also include a reservoir 32 for containing the flame resistant substance to be mixed with the fluid from the fluid supply 16 in the expansion chamber 22. The flame resistant substance can be a surfactant or any other substance known in the art that can be used as a fire retardant. The expansion chamber 22 of the fluid delivery apparatus 18 can also include a resource line 34 in fluid communication with the reservoir 32 and the expansion chamber 22, as well as a vent line 36 in fluid communication with the reservoir 32 and the expansion chamber 22. The resource line 34 carries the flame resistant substance from the reservoir 32 to the expansion chamber 22. The vent line 36 directs pressurized fluid to the reservoir 32 from the expansion chamber 22.

One end of the vent line 36 includes an L-shaped tubular member 38 that extends at least partially into the expansion chamber 22. The L-shaped tubular member 38 is positioned such that a terminal end 40 of the L-shaped tubular member 38 is directed back towards the direction fluid is entering the expansion chamber 22, or back towards the inlet 24 of the expansion chamber 22. The terminal end 40 of the L-shaped tubular member 38 of the vent line 36 faces substantially the opposite direction of the primary direction the fluid is flowing through the expansion chamber 22. The end of the resource line 34 also includes an elbow-shaped tubular member 42 that extends at least partially into the expansion chamber 22. The elbow-shaped tubular member 42 of the resource line 34 is positioned such that a terminal end 44 of the elbow-shaped tubular member 42 of the resource line 34 is directed toward the outlet 26 of the expansion chamber 22. The terminal end 44 of the elbow-shaped tubular member 42 of the resource line 34 faces substantially the same direction as the primary direction the fluid is flowing through the expansion chamber 22.

A vortex 46 is created adjacent to the terminal end 44 of the elbow-shaped tubular member 42 of the resource line 34 in the expansion chamber 22 which creates a low pressure area. This low pressure area permits the flame resistant substance to flow into the expansion chamber 22 from the reservoir 32 of flame resistant substance via the resource line 34. The low pressure area also creates a pressure difference between an inlet 48 to the vent line 36 (i.e., terminal end 40 of the L-shaped tubular member 38 of the vent line 36) and an outlet 50 from the resource line 34 (i.e., terminal end 44 of the elbow-shaped tubular member 42 of the resource line 34). This pressure difference allows the fluid entering the vent line 36 and flowing to the reservoir 32 to push the flame resistant substance from the reservoir 32 into the expansion chamber 22 via the resource line 34. The flame resistant substance entering the expansion chamber 22 mixes with the fluid, which is typically water, entering the expansion chamber 22 from the fluid supply 16. This resulting mixture is the protectant solution and is delivered to the spray conduit 28 via the outlet 26 of the expansion chamber 22. The spray conduit 28 will carry the protectant solution 14 to the openings or notches 30 in the spray conduit 28 where the protectant solution 14 will be sprayed on the building 12 at desired locations.

In one embodiment, the vent line 36 is connected to the reservoir 32 in an upper portion 52 so that the fluid from the vent line 36 is distributed on top of the flame resistant substance in the reservoir 32. The resource line 34, which delivers the flame resistant substance to the expansion chamber 22, can be connected to the reservoir 32 at a lower portion 54 of the reservoir 32. The resource line 34 connected to the reservoir 32 at the lower portion 54 permits the fluid entering the reservoir from the vent line 36 to be positioned above the flame resistant substance in the reservoir 32. In another embodiment, the flame resistant substance can be fluidically separated from the fluid entering the reservoir 32 via the vent line 36 wherein the fluid from the vent line 36 does not touch the flame resistant substance. For example, the reservoir could have an expandable and contractible bladder that the flame resistant substance or the fluid from the vent line 36 can be contained in.

The present disclosure is also directed to a method of protecting a building 12 from a potential fire by installing the fire protection system 10. The fluid delivery apparatus 18 can be connected to the fluid supply 16 and placed in a general vicinity of the building 12 for which fire prevention is desired. Spray conduit 28 can be placed at various locations adjacent to the building 12 so that the protectant solution 14 can be disposed at desired locations on the outside of the building 12. The spray conduit 28 can be held in place by support structures that extend from the ground or from the building 12. The support structures that hold the spray conduit 28 in place can be any support structure known by ones of ordinary skill in art that are capable of securing from the ground or attachable to the building 12. To force the protectant solution 14 to be created and sprayed on the building 12 by the fluid delivery apparatus 18, the fluid supply 16 needs to supply the fluid to the fluid delivery apparatus 18 as described herein.

From the above description, it is clear that the present disclosure is well-adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A fire protection system, the fire protection system comprising:

a fluid supply; and a fluid delivery apparatus receiving a fluid from the fluid supply and delivering a protectant solution to a building to prevent the building from catching fire, the fluid delivery apparatus comprising:

an expansion chamber having an inlet receiving the fluid from the fluid supply, and an outlet where the protectant solution exits the expansion chamber;

a resource line in fluid communication with the expansion chamber providing a flame resistant substance to the expansion chamber from a reservoir, the resource line having an elbow-shaped tubular member disposed on one end wherein at least a portion of the elbow-shaped tubular member is disposed inside the expansion chamber, the elbow-shaped tubular member having a terminal end generally facing the outlet of the expansion chamber; and a vent line in fluid communication with the reservoir and the expansion chamber, a pressure difference between the vent line and the resource line causes the fluid in the vent line to push the flame resistant substance from the reservoir to the expansion chamber via the resource line, the vent line having an L-shaped tubular member disposed on one end wherein at least a portion of the L-shaped tubular member is disposed inside the expansion chamber, the L-shaped tubular member having a terminal end generally facing the inlet of the expansion chamber.

2. The system of claim 1, wherein the fluid delivery apparatus further includes a spray conduit extending from the outlet of the expansion chamber to be positioned such that the protectant solution can be provided to specific portions of the building via openings in the spray conduit.

3. The system of claim 1, wherein the expansion chamber is generally cylindrically-shaped and has a diameter wherein the diameter of the expansion chamber is 60 percent to 200 percent larger than the diameter of the inlet of the expansion chamber.

4. The system of claim 3, wherein the diameter of the expansion chamber is 60 percent to 100 percent larger than the diameter of the inlet of the expansion chamber.

5. The system of claim 3, wherein the diameter of the expansion chamber is 100 percent to 200 percent larger than the diameter of the inlet of the expansion chamber.

6. The system of claim 1, wherein the fluid entering the reservoir via the vent line and the flame resistant substance are fluidically sealed from one another in the reservoir.

7. A method of installing a fire protection system on a building, the method comprising:

providing a fluid delivery apparatus that receives a fluid from a fluid supply, the fluid delivery apparatus comprising:

an expansion chamber having an inlet receiving the fluid from the fluid supply, and an outlet where a protectant solution exits the expansion chamber;

a resource line in fluid communication with the expansion chamber providing a flame resistant substance to the expansion chamber from a reservoir, the resource line having an elbow-shaped tubular member disposed on one end wherein at least a portion of the elbow-shaped tubular member is disposed inside the expansion chamber, the elbow-shaped tubular member having a terminal end generally facing the outlet of the expansion chamber; and a vent line in fluid communication with the reservoir and the expansion chamber, a pressure difference between the vent line and the resource line causes the fluid in the vent line to push the flame resistant substance from the reservoir to the expansion chamber via the resource line, the vent line having an L-shaped tubular member disposed on one end wherein at least a portion of the L-shaped tubular member is disposed inside the expansion chamber, the L-shaped tubular member having a terminal end generally facing the inlet of the expansion chamber; and positioning a spray conduit adjacent to desirous parts of the building to deliver the protectant solution from the fluid delivery apparatus to the building.

8. The method of claim 7, wherein the spray conduit extends from the outlet of the expansion chamber to be positioned such that the protectant solution can be provided to specific portions of the building via openings in the spray conduit.

9. The method of claim 7, wherein the expansion chamber is generally cylindrically-shaped and has a diameter wherein the diameter of the expansion chamber is 60 percent to 200 percent larger than the diameter of the inlet of the expansion chamber.

10. The method of claim 9, wherein the diameter of the expansion chamber is 60 percent to 100 percent larger than the diameter of the inlet of the expansion chamber.

11. The method of claim 9, wherein the diameter of the expansion chamber is 100 percent to 200 percent larger than the diameter of the inlet of the expansion chamber.

12. The method of claim 7, wherein the fluid entering the reservoir via the vent line and the flame resistant substance are fluidically sealed from one another in the reservoir.

* * * * *